US006460843B1

(12) United States Patent
Dim et al.

(10) Patent No.: US 6,460,843 B1
(45) Date of Patent: Oct. 8, 2002

(54) PAPERBACK FINISHING MACHINE

(75) Inventors: Yuval Dim, Tel-Aviv; Ilan Weiss, Kfar-Sava, both of (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/495,942

(22) Filed: Feb. 2, 2000

(51) Int. Cl.[7] ..... B41F 13/64; B42B 43/00; B42D 15/00

(52) U.S. Cl. ..... 270/58.07; 412/4; 412/16; 412/19

(58) Field of Search ..... 270/58.07, 58.08, 270/58.09; 412/1, 2, 3, 4, 16, 19, 33, 900, 901, 902

(56) References Cited

U.S. PATENT DOCUMENTS

| | | | | | |
|---|---|---|---|---|---|
| 4,800,110 | A | * | 1/1989 | DuCorday | 412/900 X |
| 5,465,213 | A | * | 11/1995 | Ross | 270/52.18 X |
| 5,536,044 | A | | 7/1996 | Luhman et al. | |
| 5,569,012 | A | * | 10/1996 | Kosasa et al. | 412/33 |
| 6,012,890 | A | | 1/2000 | Garrido | |
| 6,076,817 | A | * | 6/2000 | Kobayashi et al. | 270/58.09 |
| 6,142,721 | A | * | 11/2000 | Marsh | 412/1 |
| 6,155,763 | A | | 12/2000 | Parker et al. | |
| 6,199,851 | B1 | * | 3/2001 | Latvakangas et al. | 270/58.08 |

FOREIGN PATENT DOCUMENTS

| | | | |
|---|---|---|---|
| EP | 0504489 | | 9/1992 |
| EP | 0752671 | A2 | 1/1997 |
| EP | 829832 | | 3/1998 |
| WO | WO 99 17934 | A1 | 4/1999 |
| WO | WO 00/3876 | | 1/2000 |
| WO | WO 00/03876 | * | 1/2000 |

* cited by examiner

*Primary Examiner*—Christopher P. Ellis
*Assistant Examiner*—Patrick Mackey
(74) *Attorney, Agent, or Firm*—Eitan, Pearl, Latzer & Cohen-Zedek

(57) ABSTRACT

The invention teaches a paperback book-finishing apparatus comprising a collator, a cover trimmer (with optional scorer), a glue cutter, and a binder. The apparatus can automatically finish books of different thicknesses. The operations of cover trimming, glue cutting and placement, and collating are all carried out by aligning to a common alignment edge. The glue cutter cuts glue strips of variable width and the collator collates printed sheets by synchronized tamping. The apparatus can be used with in-line, on-demand page printers and in-line, on-demand cover printers. The apparatus can be used in book vending machines.

46 Claims, 15 Drawing Sheets

PAPERBACK FINISHING MACHINE

FIELD OF THE INVENTION

The present invention relates to a hook-finishing apparatus in general and to such apparatus that performs the finishing operations of a print on demand book printing machine, in particular.

BACKGROUND OF THE INVENTION

Finishing machines have been known since the first books were printed. These machines use a wide assortment of binding methods including saddle stitch (stapling), velo binding, comb binding, spiral binding, tape binding, perfect (adhesive/paperback) binding, case (hardcover) binding, etc. Paperback books are generally prepared using perfect binding and require page and cover trimming after the binding process is complete. In addition, the pages and covers are not printed in-line in most paperback book systems.

Currently, there are some finishing machines that can be coupled directly to printing systems, usually to printers made by other manufacturers. Kodak's Imagesource 92 printer, which is joined to a Duplo finisher, is such a combination. However, the latter uses saddle stitch binding and it not a perfect binding system. The Planax perfect binder (Planax NA Inc.) is an off-line perfect binder which is compatible with Generous DocuTech printing system. The Xerox DocuTech system hoc also been linked to a C.P. Bourg Inc. perfect (hot-melt glue) binder. But this latter system requires post-binding trimming of the book's head, foot, and face.

The perfect binding machines available today fail to address a number of issues. They are usually not fully automatic and do not operate in-line with an on-demand printer. They are usually not compact and would not be suitable for use within the narrow confines of offices or book retailers who produce books using on demand digital printers. In addition, in these perfect binding machines, both the book's cover and pages usually require trimming after completion of the binding process to achieve trade or paperback book quality. This is an indication that page alignment is inadequately maintained throughout the finishing process.

A finishing machine overcoming these deficiencies is needed for incorporation into paperback book vending machines, office digital printers, or on-demand printing machines found in bookshops. The finishing machines at these locations would be operated by the consumer, office personnel or book retailers. In all instances, the finishing apparatus would be directly linked to an on-demand in-line printer. Such a vending machine is described in Israeli application No. 125389 assigned to the common assignee of the present application, that application being incorporated herein by reference. Such vending machines would enable book dealers to maintain lower hardcopy inventories. They also will help meet demand for out-of-print titles through use of digital book archives.

SUMMARY OF THE INVENTION

The present invention is a compact book finishing apparatus meeting the needs described above. It can be integrated with digital and non-digital printers or with conventional or digital copiers. The apparatus is automatically adjustable for finishing books of varying widths (thicknesses). It can be used in paperback book vending machines, small print shops, bookstores or offices. This invention binds books without requiring post-binding trimming while producing books of trade paperback quality.

The invention relates to an automatic book-finishing apparatus for finishing a book, where the book has a spine which can be of any width. The apparatus comprises a cover trimmer which trims a book cover, the book cover having a rectangular center area coincident with the spine. The center area has a long edge and a short edge, where the length of the short edge is automatically adjustable according to the total number of pages in a specific book. The apparatus also comprises a glue cutter which cuts a glue tape into a glue strip of variable width and aligns the glue strip with the long edge of the cover's center. The apparatus further comprises a collator which collates and aligns printed sheets into a book block of valuable width and further aligns the book block with the long edge of the cover's center area. Finally the apparatus comprises a binder which binds the book along said spine.

The invention further teaches a book-finishing apparatus as taught above where the glue cutter cuts a glue tape into a glue strip, where the glue strip has a width generally equivalent to the length of the short edge of the center area.

The invention further teaches a book-finishing apparatus as taught above where the glue cutter positions the glue strip on the book cover and aligns the glue strip with the long edge of the center area.

The invention further teaches a book-finishing apparatus as taught above where the collator comprises means for collating the printed sheets into a book block, aligning the edges of the printed sheets to an end surface of the collator and further aligning the book block with the long edge of the cover's center area.

The above apparatus has a collator which comprises a collating means which collates and aligns printed sheets into a book block. The collator comprises a clamping means which clamps the book block when collating is complete and a rotating means which rotates the book block to a position substantially perpendicular to the book cover after the book block has been clamped. Finally, the collator further comprises an aligning means which aligns the book block along the long edge of the center portion of the cover.

The collating means of the apparatus comprises a receiver unit for receiving the printed sheets. The unit further comprises a base and a plurality of restraining elements mounted on the base. The restraining elements form a rectangle generally of the same size as the printed sheets. The collating means further comprises at least one active element which tamps and aligns the printed sheets when they are within the receiver unit. A synchronizer activates the at least one active element when a paper sheet is received in the receiver unit.

The invention further teaches A book-finishing apparatus as taught above for use with an on-demand printing machine.

The apparatus may further comprise a central control under which is in communication with and controls at least one of the following: the collator, the cover trimmer, the glue cutter, and the binder. Finally the apparatus can be in communication with And control a printing machine.

The invention also teaches a method for finishing a book where the book has a spine. The method comprises the steps of collating, aligning and clamping printed sheets into a book block; rotating the aligned and clamped book block to a position substantially perpendicular to the book cover; trimming a book cover where the cover has a rectangular center area with a long and a shod edge and the center area is coincident with spine; cutting a glue strip from a glue tape with the glue strip having a width generally equivalent to the length of the short edge of the center area, positioning the glue strip along the long edge of the center area: aligning the book block with the glue strip along the long edge of the center area of the cover, binding the book along said spine: and releasing the clamped book block. Within the trimming step, the method can also include a step of scoring the book cover. The scoring consists of at least a single score, with at least one score being co-linear with the long edge of the center area of the cover.

The invention teaches a book-finishing apparatus which is integratable with an on-demand printing machine, preferably a digital printing machine, and/or an on-demand cover printer. The book-finishing apparatus is also connectable and usable with a book vending machine.

BRIEF DESCRIPTION OF THE DRAWINGS

Attention is now directed to the attached drawings, wherein like reference numeral or characters indicate responding or like components in the drawings.

DETAILED DESCRIPTION OF THE PRESENT INVENTION

Figure 1:
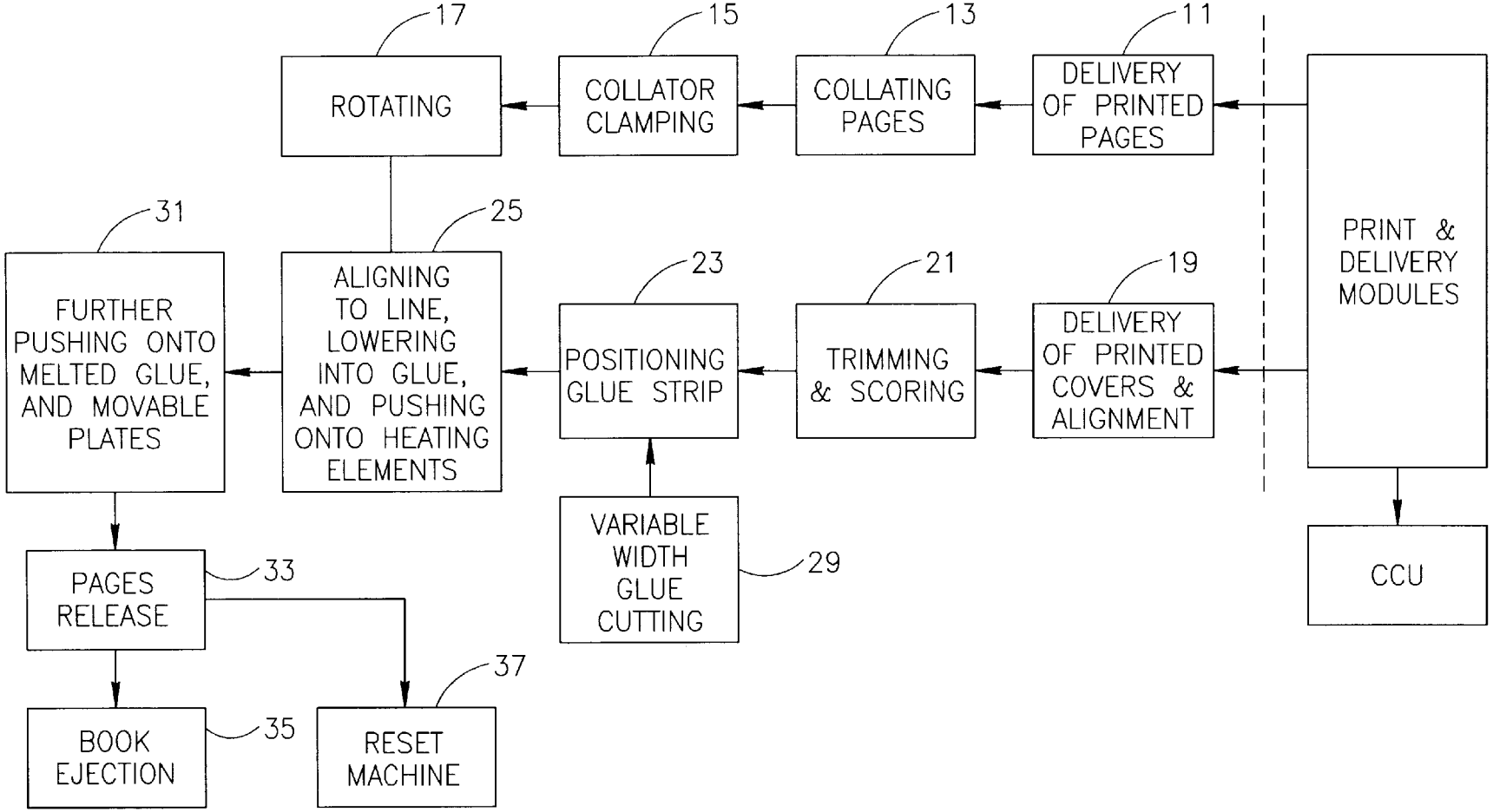
FIG. 1 is a block diagram of the operations performed by the invention.

Reference is made to FIG. 1 which shows the various operations involved in binding a soft cover book. The process begins with the delivery of loose printed sheets (operation 11) from a printer (not shown) followed by their collation by a collator (operation 13). After the last printed page reaches the collator, the collator clamps the pages into a book block (operation 15). The clamped collated book block is rotated (operation 17) so that the book block's spine faces downward.

While operations 11 through 1/ are performed, the cover is processed. The cover is printed (printer not shown) and delivered by conveyor or other means (operation 19) to the cover trimmer module (operation 21). The cover is trimmed and optionally scored as explained below and moved on to the glue cutter operations 23 and 29). The glue cutter cuts a strip of hot-melt glue (operation 29) and positions it on the cover's spine (operation 23). The width of the strip can be varied and depends on the thickness of the book being finished. The strip is then affixed firmly to the cover by applying heat through the cover at several points, usually two points.

The cover, with the strip of glue attached to it, it conveyed to the binding module where the spine of the cover is placed above heating elements. The rotated book block is then lowered and carefully aligned with the spine. The block pushes down on the spine activating the heating elements melting the glue strip (operation 25).

In operation 31, the clamped pages are lowered further onto the affixed glue strip, pushing the cover even further against the hot heating element melting the glue strip entirely. Cylinders force movable plates to press against the sides of the spine, causing the cover to fold up.

In operation 33, the clamp holding the book block is loosened and the bound book is released and ready for ejection. Releasing the movable plates allows for the ejection of the book from the machine (operation 35): resetting of the machine for the next binding operation (operation 37) completes the cycle.

Figure 2:
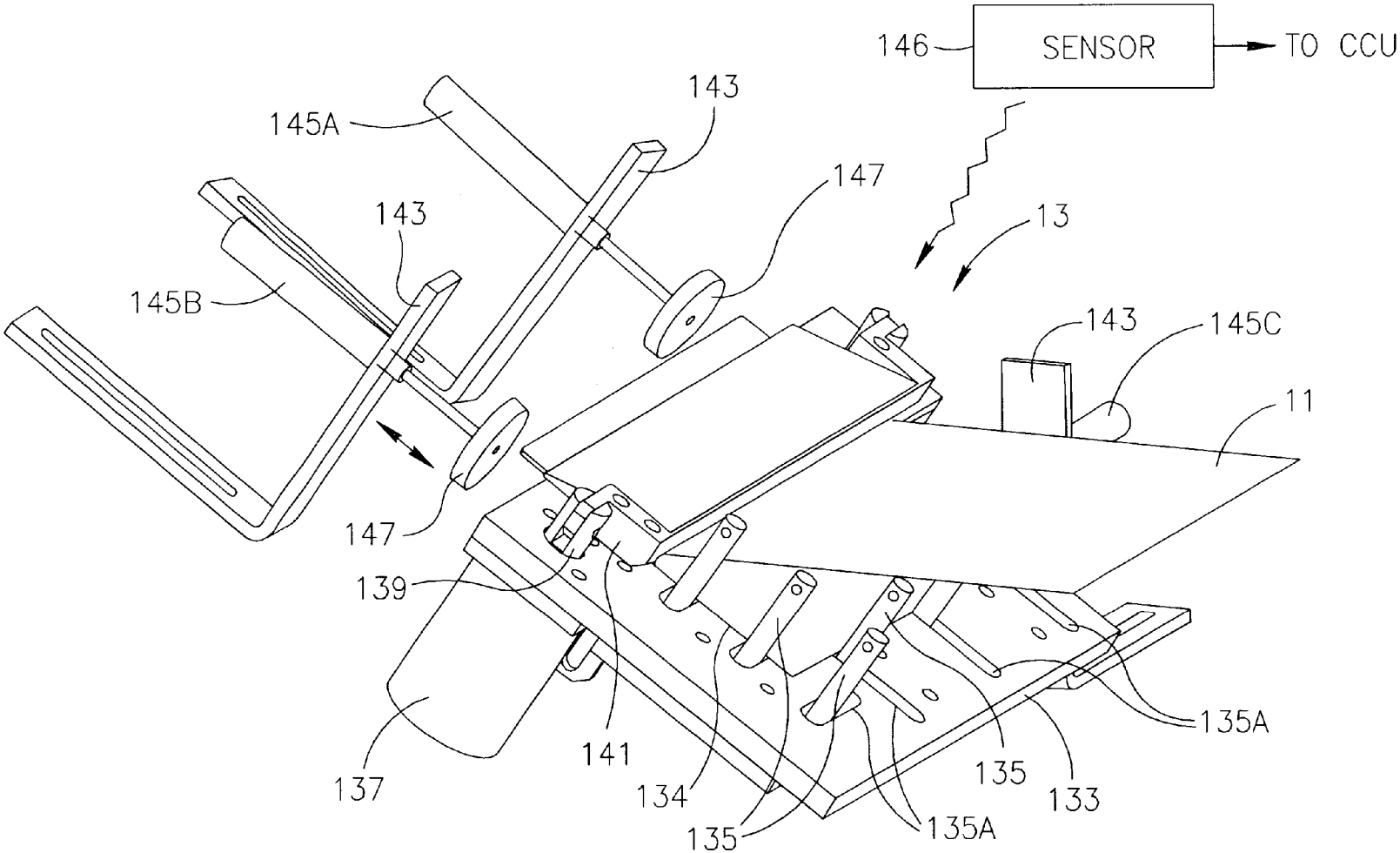
FIG. 2 is an isometric view of the collator in the collation position.

FIG. 2 shows the collator used in operations 13 and 16 of FIG. 1 in greater detail. A single printed page 11 is delivered to the collator by a conveyor (not shown). The page is conveyed between two rows of orthogonal pins 135 and under the raised bridge of the clamp 141. The collator base 133 is slanted backwards so that a page when blocked by the two bumpers 14/ slides backward and rests on previously stacked pages 134 between pins 136. The pins 135 act as restraining elements. The collator base 133 and the pins 135, or other type of restraining elements, function as a receiver unit for the pages.

While the collator base 133 is shown in FIG. 2 as inclined, in another embodiment it can be horizontal. In yet another embodiment, the receiver unit can be vertical and no rotation, as described below, would be necessary. In a further embodiment, the receiver unit can be positioned so that it receives paper from below, i.e. the receiver unit faces below the horizontal plants and is either inclined, vertical, or horizontal with respect to that plane.

At this point the central control unit (not shown hereinafter but referred to as the CCU), which also can control an on-demand printing machine often a digital printing machine, activates two front pneumatic cylinders 145A and 145B and a single lateral one 145C. These extend and tamp the uppermost page 11 gently, aligning it with the previous pages 134 against the pins 135 The three cylinders 146 then return to their initial positions where they are, held in place by brackets 143. The pneumatic cylinders constitute an "active" alignment mechanism synchronized with the entry of the printed sheets. While the above Figure shows three tamping units 145A, 145B, 145C. In other embodiments fewer than three may be acceptable. In some cases even a single tamping unit could successfully align the incoming pages.

Synchronization refers to timing the activation of the pneumatic cylinders 145 with the delivery of the printed sheets. Each cylinder 146 is electronically activated when a detector detects the new page entering the collator. The detector is usually an optical detector. The electronics and detector elements, of the synchronization mechanism are not shown in the Figure.

After the incoming sheet A detected and after an appropriate delay to optimize tamping efficiency, the electronically activated cylinders 145 tamp the entering sheet. This is repeated for each individual sheet.

After the last page of the book has been delivered to the collator and the aligning cycle has been performed, the CCU activates the collator clamping mechanism. The CCU causes two pneumatic cylinders 137 to retract. This results in rods 130 pulling on bridge 141, damping the loose sheets into an aligned stack. Solenoids or any other linear actuator mechanism can activate the rods 139.

Figure 3A:
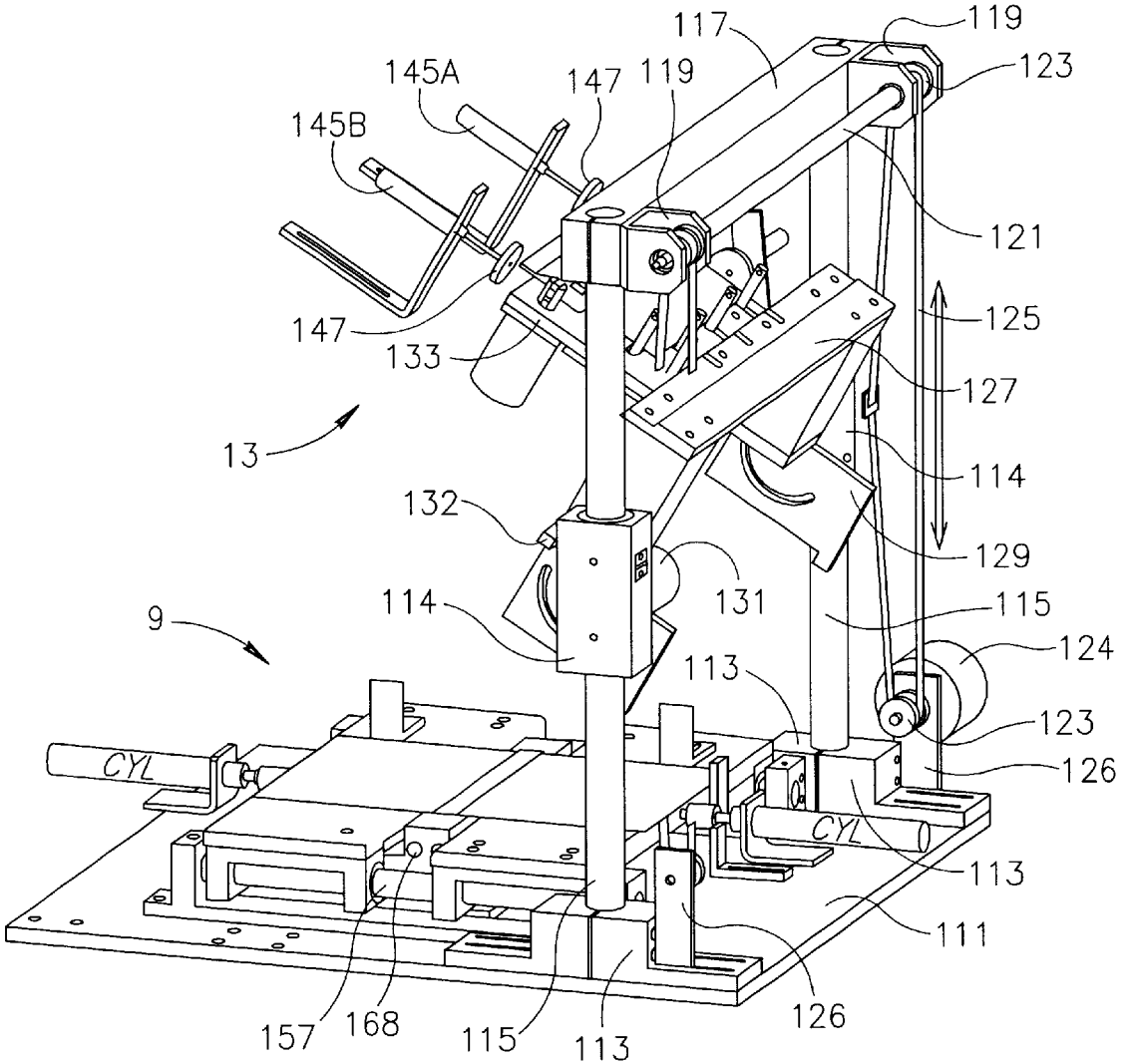
FIG. 3A is an isometric view of the collator and binder in the "collation" position.

At the conclusion or the clamping operation, the CCU activates the collator rotation mechanism. As seen in FIG. 3A, the collator 13 is attached by its base plate 127 to two side plates 129. Side plates 129 are connected to two carriages 114 via hearings (not shown) which enable the collator to rotate around its horizontal axis. The housing of an electric motor 131 is located on the side plate 128; the motor's shaft and pinion are not shown. The pinion is meshed with a gear segment (also not shown) and attached to the carriage 114. Activating the motor 131 rotates the collator frame around the horizontal axis. Other methods, such as pistons, can be used to rotate the collator.

As shown in FIG. 3A, there are four brackets 113 on base plate 111 which hold two vertical, typically round, rails 115. Two movable carriages 114 sit on the rails 115, with the rails 115 connected at their top by a rod 117. The rod 117 carries two brackets 119. A horizontal shaft 121 is supported by bearings (not shown) held in the brackets 119. There are two timing pulleys 123 fastened to the shaft 121, but for clarity, only one pulley is show in the Figure. On the new side of the base plate 111, another timing pulley is assembled via a bracket (the letter not shown), while at the far side a bracket 120 carries an electric motor 124. A timing pulley 123 is assembled on its shaft. The two timing belts 126 run on the pulleys 123 with each attached to a carriage 114. Activating the motor 124 raises or lowers both carriages 114 and the collator 13 attached to them.

FIG. 38 shows the downward rotation of the collator module 13 which is braked when the stop bracket 132 connects with 9 stopping element (not shown). At this position the motor 131 is braked.

The precise book block alignment resulting from collation is maintained even after rotating and lowering the book block into the gluing position as shown in FIG. 38. The book block is lowered in such a way that one face is always aligned with the inside edge of the book's spine. The position of the latter, is determined by the invariant distance $D_n$ shown in FIG. 3B. This line corresponds to edge 200 shown below in FIG. 7A. The edge also corresponds to the long edge of the rectangular center area of the book cover, the area being coincident with the cover's spine. The position of the book block's other face varies with the book's thickness.

Figure 4A:
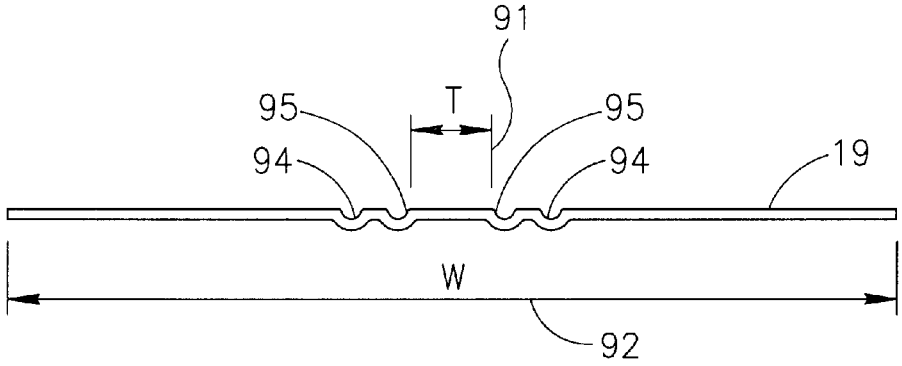
FIG. 4A is a front view of the trimmed and scored cover.
Figure 4B:
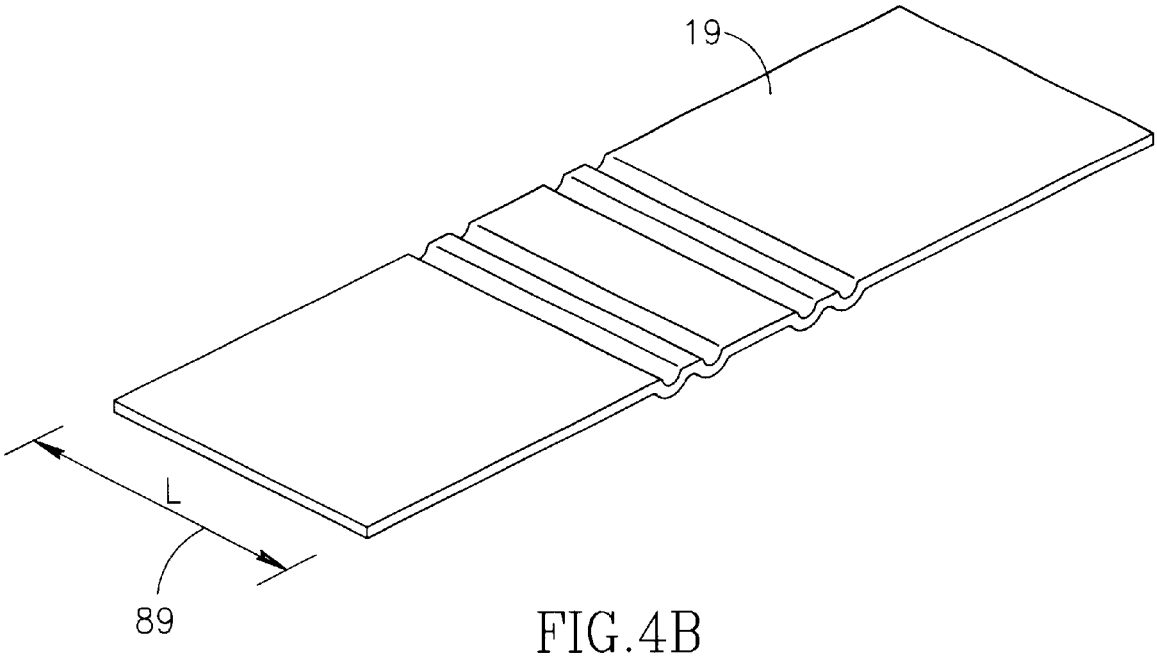
FIG. 4B is an isometric view of the trimmed and scored cover.

The CCU can also control the cover printer, often an in-line, on demand cover printer. Among other things, it can regulate when the cover printer delivers a cover to the finishing machine. A cover with its printed side facing downward is delivered to the cover trimmer module (hereinafter referred to as CTM). FIG. 4A shows a front view of a finished, scored and trimmed cover 19, while FIG. 4B is an isometric view of the some cover.

The cover length, L, 89 corresponds to the length of the printed pages and is fixed for a given setting of the machine. The total width W 92 of the cover and the cover's spine T 91 vary depending on the number of Pages in the book being printed and the thickness of the individuals pages. The four scores 94, 95 act as hinges with which to told the cover. The two inner scores 95 are spaced T mm apart 91 and correspond to the thickness of the collated pages. The two outer scores we used as "hinges" to neatly open the book.

Figure 5:
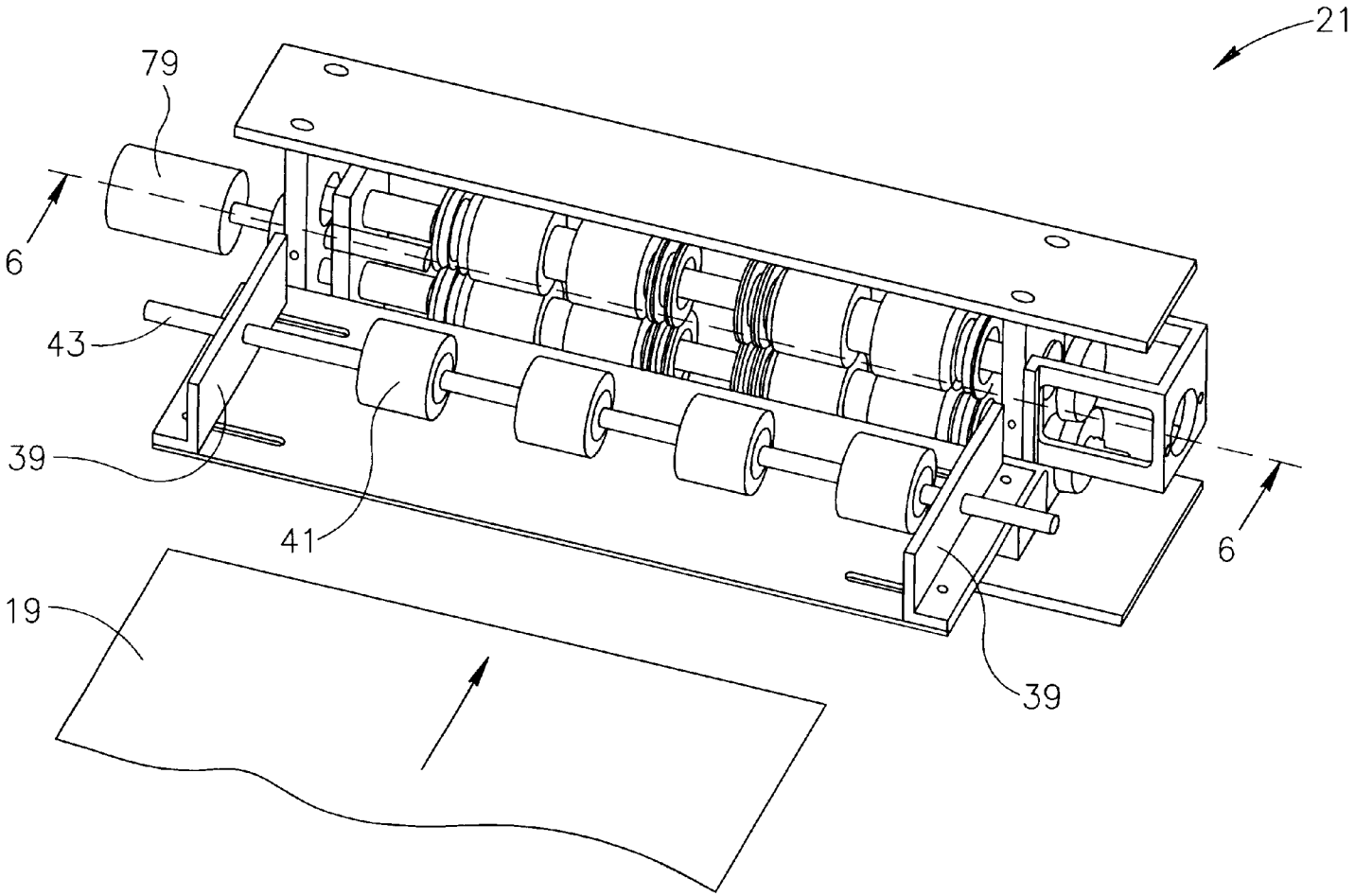
FIG. 5 is an isometric view of the cover trimmer.

FIG. 5 shows an isometric view of the cover trimmer (CTM) 21. Side guides 39 and a pair of rubber rollers 41 guide the cover 19. In FIG. 5, only one shaft is shown. The rollers 41 are mounted on motorized shaft 43 with the motor not shown. The rollers turn in opposite directions in order to grip the cover 19 and push it into the CTM 21.

Figure 6:
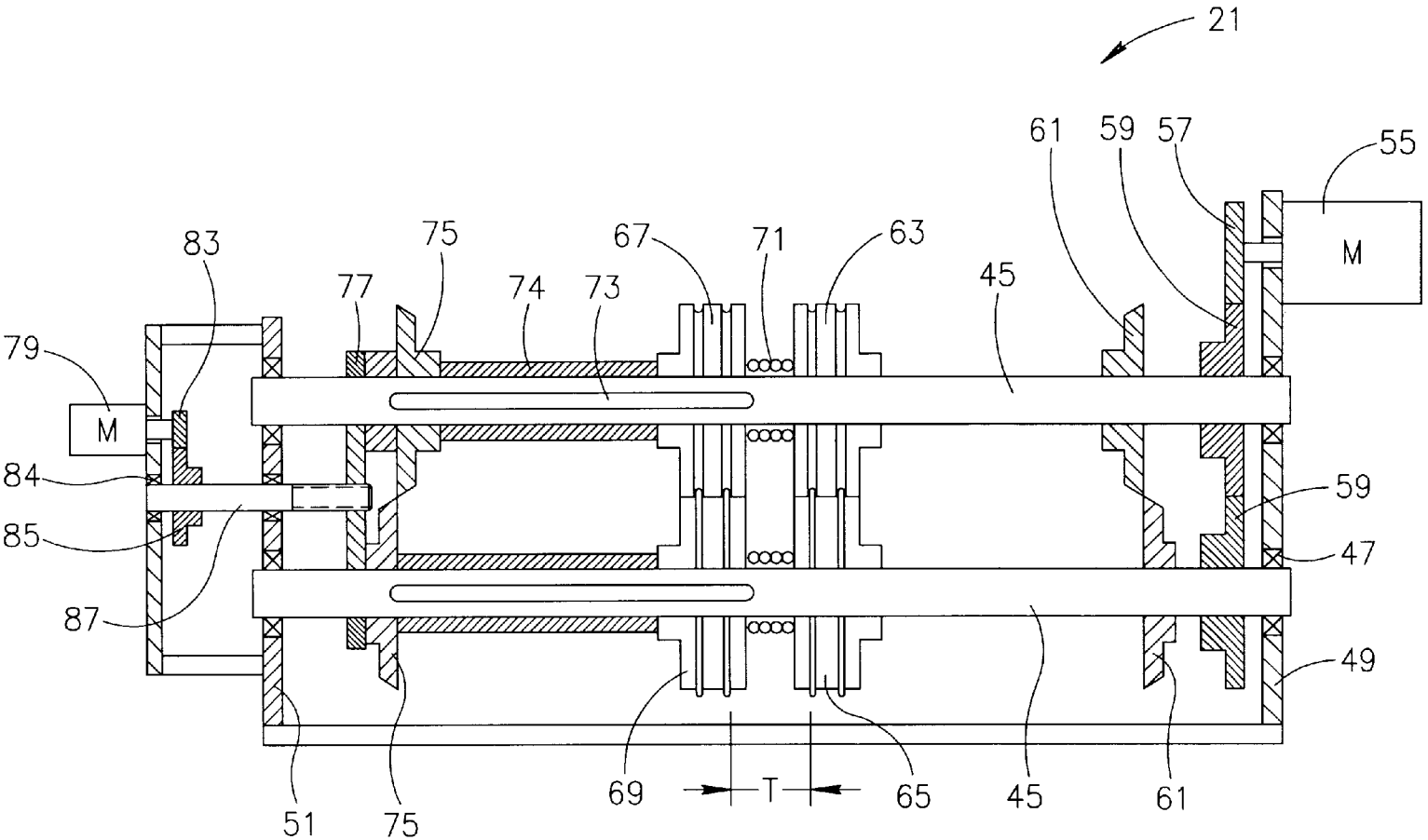
FIG. 6 is a section view of the cover trimmer.

FIG. 6 shows a section view of the CTM 21. Two parallel shafts 45 are mounted on bearings 47 held in the right side plate 49 and the left side plate 51. Motor 55 bears a pinion 57 that is meshed with gear 59, the latter being attached to the upper shaft 45. An identical gear 59 is attached to the lower shaft with the two shafts 45 running in opposite directions. Two round cutters 61, fastened to the rotating shafts 45, trim the right side of the cover 19.

Grooved scoring roller 63 and embossed scoring roller 65 are attached to shaft 45. The spacing between the scoring rollers 63, 65 and cutters 61 corresponds to the required location of the first 94 and second 95 scores on the right hand side of the cover (FIG. 4A). A similar pair of scoring rollers, 67, 69 are attached to shafts 45 on the left side of the CTM; these rollers are moved along shafts 45 and keys 73 by two compression springs /1.

The distance between the spacers 74 located between the scoring rollers 67, 69 and the left-hand round cutters 76 corresponds to the width of the left-hand side of the cover. To adjust for the different thicknesses of the books that will be bound, motor 79 turns lead screw 87 via a pair pinion 83 and a gear 85. The lead screw 87 is hold in place by bearings 84 and is threaded in side plate 77. Activating motor 79 turns the lead screw 87 so as to push or pull side plate 77, changing distance T 91 which corresponds to the thickness of the book.

FIG. 6 shows a CTM with scoring rollers which produce four scores. In other embodiments the scoring rollers can he adopted so as to effect only two scores. In the latter case, the scores produced would correspond to the inner scores of the above embodiment and represent the edges of the covet's spine. In yet other embodiments, it is possible to modify the CTM and finish paperback books without any scoring, although the binding in such books maybe a poorer quality.

Control of the scoring process can be effected in several ways. First, the CCU can contain archived information about the number of pages in a given volume and the thickness of each page. After calculating the book block thickness from the archived data, the CCU transfers the information to the CTM which would then adjust T 91. Alternatively, a sensor 146 (see FIG. 2) that detects the actual thickness of a collated book block can be attached to the collator. The sensor would then transmit this information to the CTM via the CCU, and the CTM would automatically adjust T 91, the distance between the inner scores 95.

The sensor on the collator can also be in communication with the cover printer (not shown). Instead of printing the entire cover all at once based on archived information from the CCU, the sensor can control printing of the book's cover in stages. The front cover can be printed immediately based on CCU archived data. Data from the sensor on the thickness of the collated book block can then be transmitted via the CCU to the cover printer where printing of the book's spine would be adjusted and varied based on the book title being printed. The back cover can then be printed using additional archived data from the CCU.

Figure 7A:
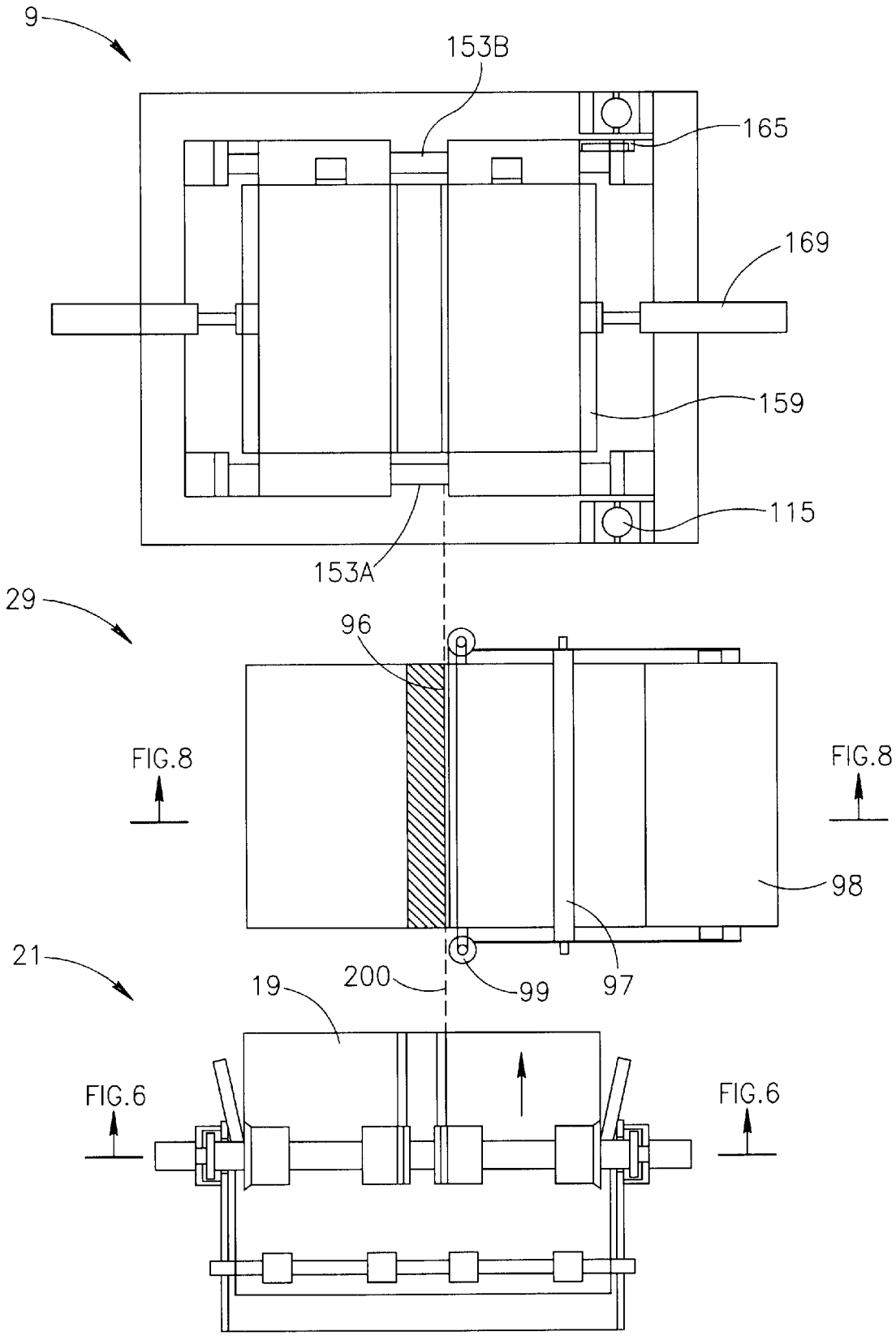
FIG. 7A is a top view of the cover trimmer, the glue cutter and the binder comprising the invention.
Figure 8A:
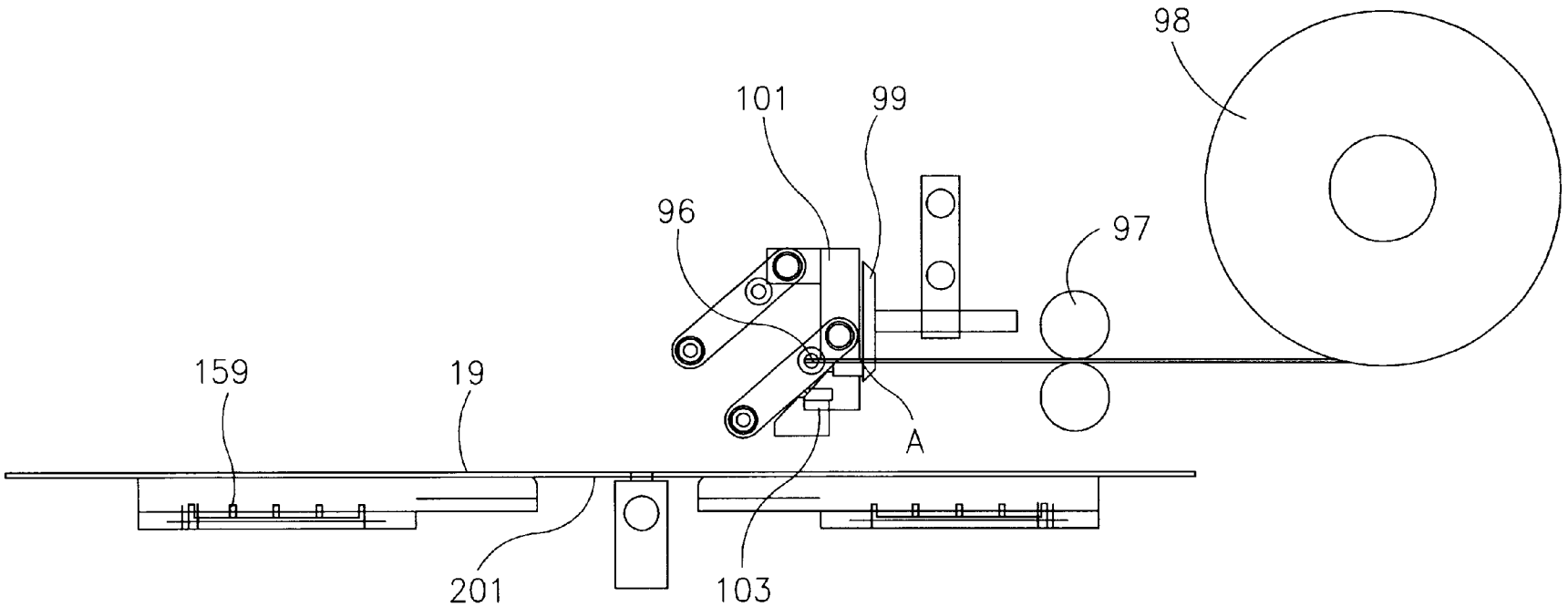
FIG. 8A is a side view of the glue cutter using a rotating knife.
Figure 8B:
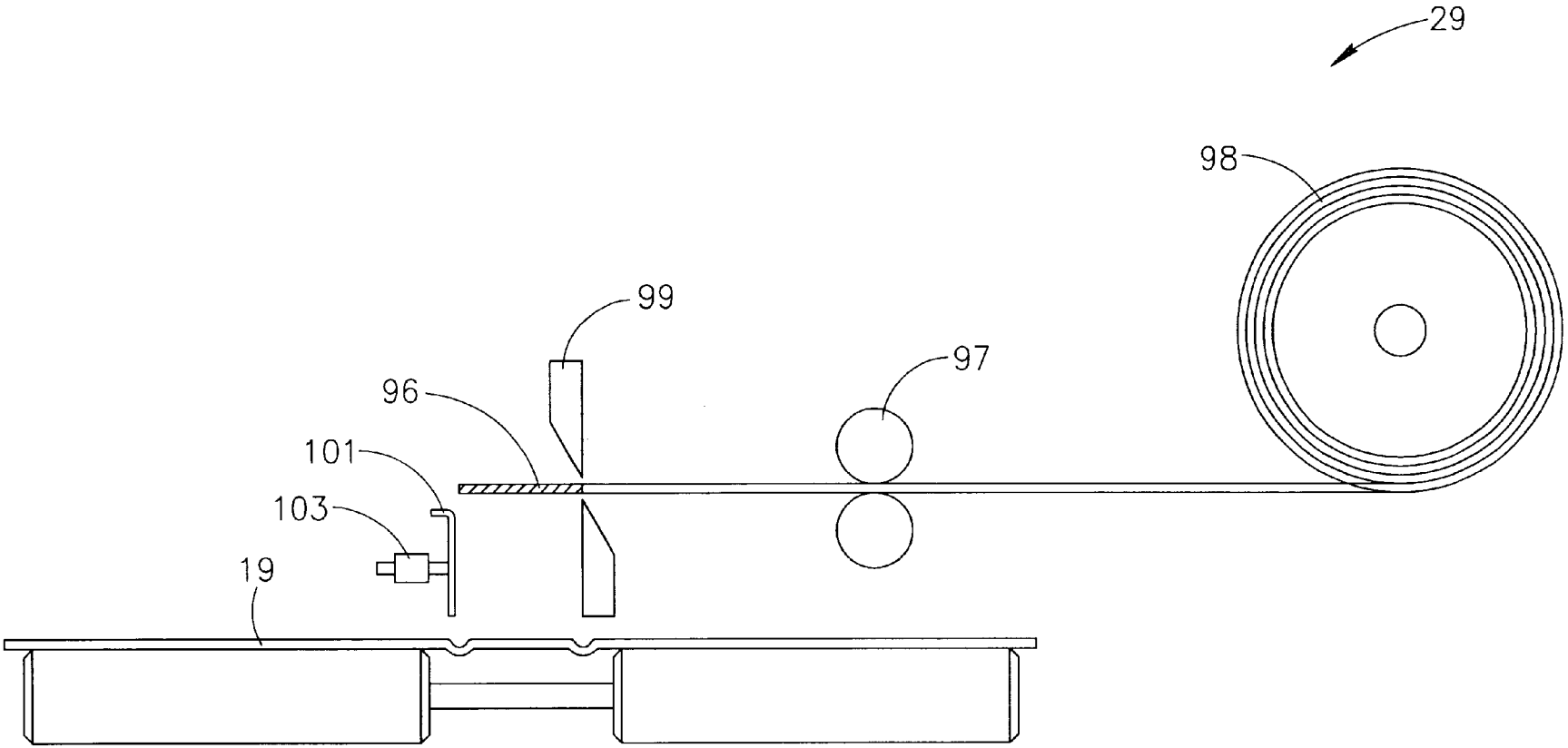
FIG. 8B is a side view of the glue cutter using a guillotine knife.
Figure 9:
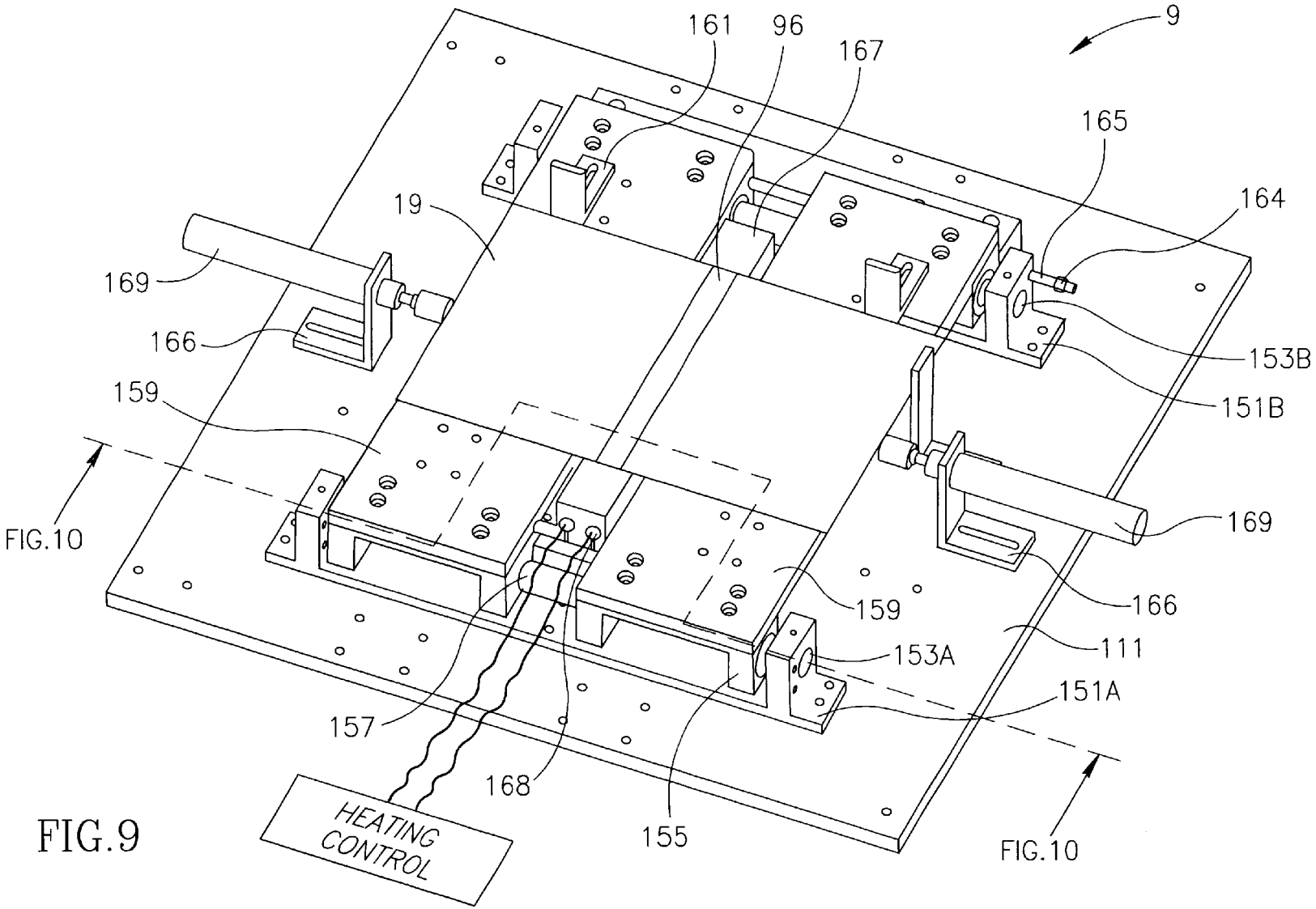
FIG. 9 is an isometric view of the binder shown in FIGS. 3 and 7.

FIG. 7A shows a top view of the layout of the CTM 21 of FIG. 6, the glue cutter (GC) module 29 of FIGS. 8A, and 8B, and the binding module 9 of FIG. 9. FIG. 7A shows the alignment reference edge 200 discussed previously to which the collator 13 aligns the book block 11 in FIG. 3A. In FIG. 7A, the book cover 19 and movable plates 169 are located at the binding module 9.

Figure 7B:
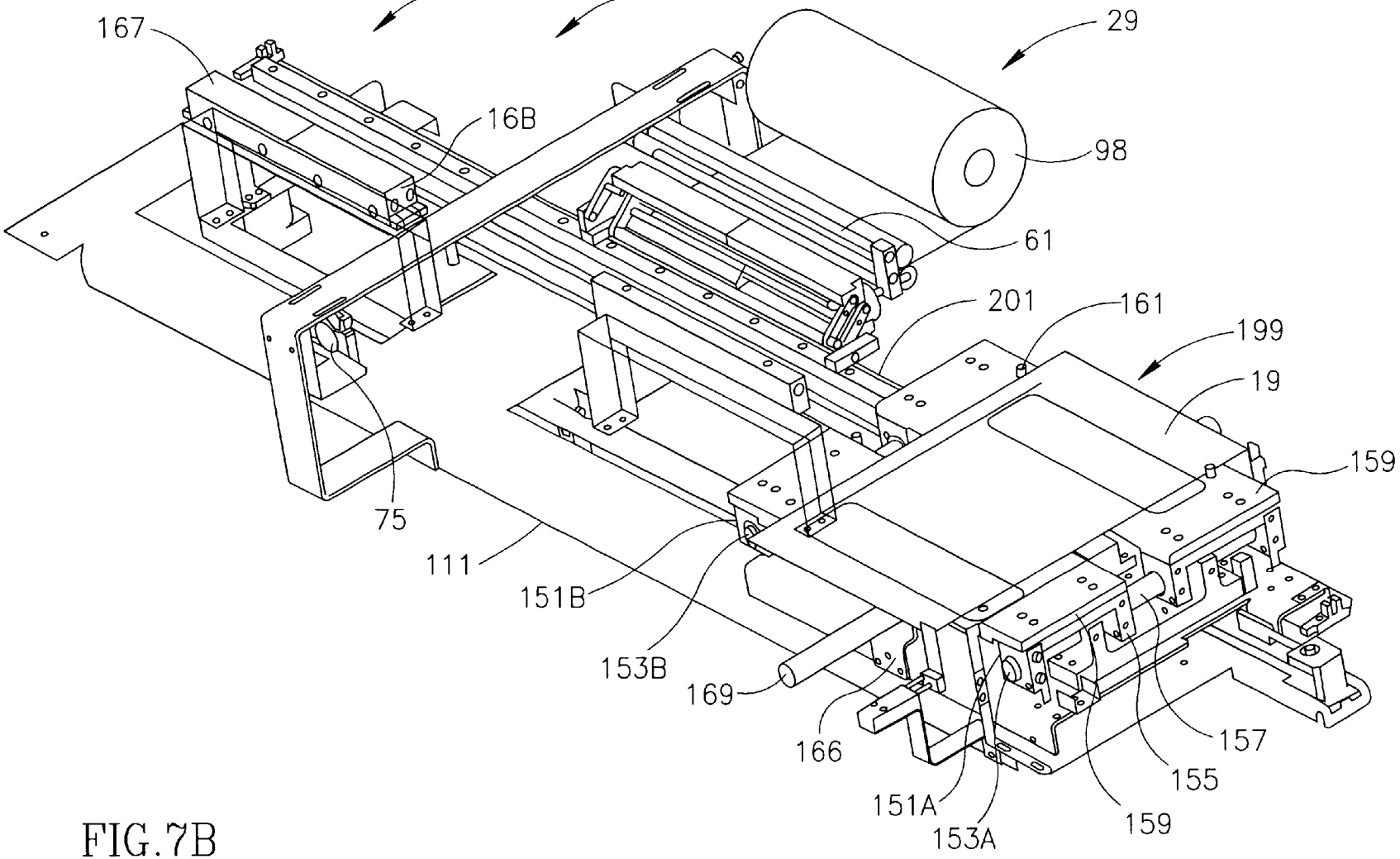
FIG. 7B is a side view of the cover trimmer, the glue cutter and the binder comprising the invention.

FIG. 7B shows another embodiment of the CTM 21, GC 29 and binder 9. The cover 19 and Movable plates 159 are shown at positioning station 199. The cover trimming mechanism of FIG. 5 and FIG. 6 shown in FIG. 7A does not appear. Rather, in FIG. 7B, another embodiment of the CTM 21 is shown, one lacking scorers but still including cutters 61 and 75. These latter are positioned immediately after the GC 29. The cover is moved on the travel movement 201 from the positioning station 199 to the GC 29 and then on to the cutters 61, 75 of the CTM 21. Cutter 75 is moved according to the calculated or measured book thickness as discussed above with respect to the CTM. Cutter 81 is held in a fixed position with reference to the fixed reference line to which all elements of the book, such as the book block 11 discussed above and the glue strip 96 discussed below, are aligned. From the CTM 21, the cover moves an the travel movement 201 to the binder 9.

FIG. 8A shows the glue cutter (GC) module. The GC's task is to cut a strip of hot-melt glue. The glue at ambient tempertures may be stored as turnable roll 98. The cover is positioned on movable plates 159 and conveyed to the GC 29 from the CTM 21 along travel movement 201 as in FIG. 7B.

FIG. 8A shows a side view of the glue cutter (GC) module. When activated by the CCU, the motorized rollers 97 pull a precisely determined length of the glue roll 98 onto the flat "table" 103. After the glue advances the required distance as determined by the CCU's archived data for a given book title, the motorized rollers 97 are braked and roller cutter 99 cuts a strip of glue. Rotating glue strip holder 101 then removes the cut strip 96, holds it, rotates it and aligns it on cover 19. Point A in FIG. 8A indicates the glue strip edge which is rotated directly onto edge 200, best seen in FIG. 7A. This line is the same line to which the CTM scores the cover as described above and the same line to which the collated book block is lowered also as discussed above (FIG. 3B). While the above embodiment uses a roller cutter 9, other embodiments, such as the one in FIG. 8B can use a GC fitted with a guillotine cutter 99.

The size of the strip to be cut can be calculated on the basis of the number of pages and the thickness of each page. This date can be stored in the CCU for each individual title and then transmitted to the GC. An alternate embodiment would include a sensor in the collator to measure the thickness of each book block. The sensor would transmit the results of each measurement to the CCU. The CCU would then feed the data to the GC.

When movable plates 159 are activated on travel movement 201, they move the cover 19 with the glue strip 96 affixed to it to the binding module 9 (FIG. 9). This is best seen in FIG. 7B.

FIG. 9 shows the binder base mechanism of the binding module 9 first encountered in FIGS. 7A and 7B. Two parallel round shafts 153A, 153B are mounted on the base plate 111 with brackets 151A, 151B respectively. Two plates 159 into mounted between shafts 153A, 153B and are moveable on the shafts 163 via sliders 157 and brackets 155. Shaft 153 and sliders 157 as shown in the Figure are well known in the art. Between the plates 159 is a metallic housing 167 which includes electric heaters 168.

In FIG. 9, there are two brackets into on base plate 111, each carrying a horizontal pneumatic cylinder 169. The rods of the cylinders 169 are attached to the movable plates 159. When the pneumatic cylinders 169 are activated, they cause the plate 159 to move towards or away from the heating housing 167. The right hand plate 159 is limited in its inward movement by a stop screw 165 and stop nut 164 (seen better in FIGS. 10 and 11). Screw 165 and nut 164 align the inner face of the right hand plate 159 with the location of the cutters 99 shown in FIGS. 8A and 8B. They also align the inner face of the right hand plate 159 with the location of the wheel cutters 61 shown in FIG. 6 and with the location of the face of the block bundle in the collator 13 after it is rotated as in FIG. 3B. Thus the right hand sides of the collator, GC and CTM modules all use the same general aligning reference. The alignment edge 200 is seen most clearly in FIG. 7A.

Not shown in FIG. 9 is the possibility of including a vacuum system to hold the cover 19 in place. The openings transmitting the vacuum the under the area hidden by the covers. These openings are attached to a vacuum system which is not shown.

FIG. 10 shows that heating housing 167 is coplanar with moving plates 108 when no force acts on it. The housing can move downward with its motion in that direction opposed by springs 175. As shown in FIG. 9, cover 19 it conveyed by the movable plates 159 onto the binding module 9 until stopped by stops 161. The center portion of the cover 19 and the strip of glue 96 rest on the heating housing 167.

As described previously with FIG. 38, before commencing to lower the hook block 11 into the glue, the book block 11 is clamped by the collator 13 and held in a vertical position with its spine facing downwards. The first face of the book block 11 is aligned with one edge of the covers 19 spine. The CCU activates electric motor 124 (FIG. 3A) and lowers the book block 11 into the glue.

Figure 11:
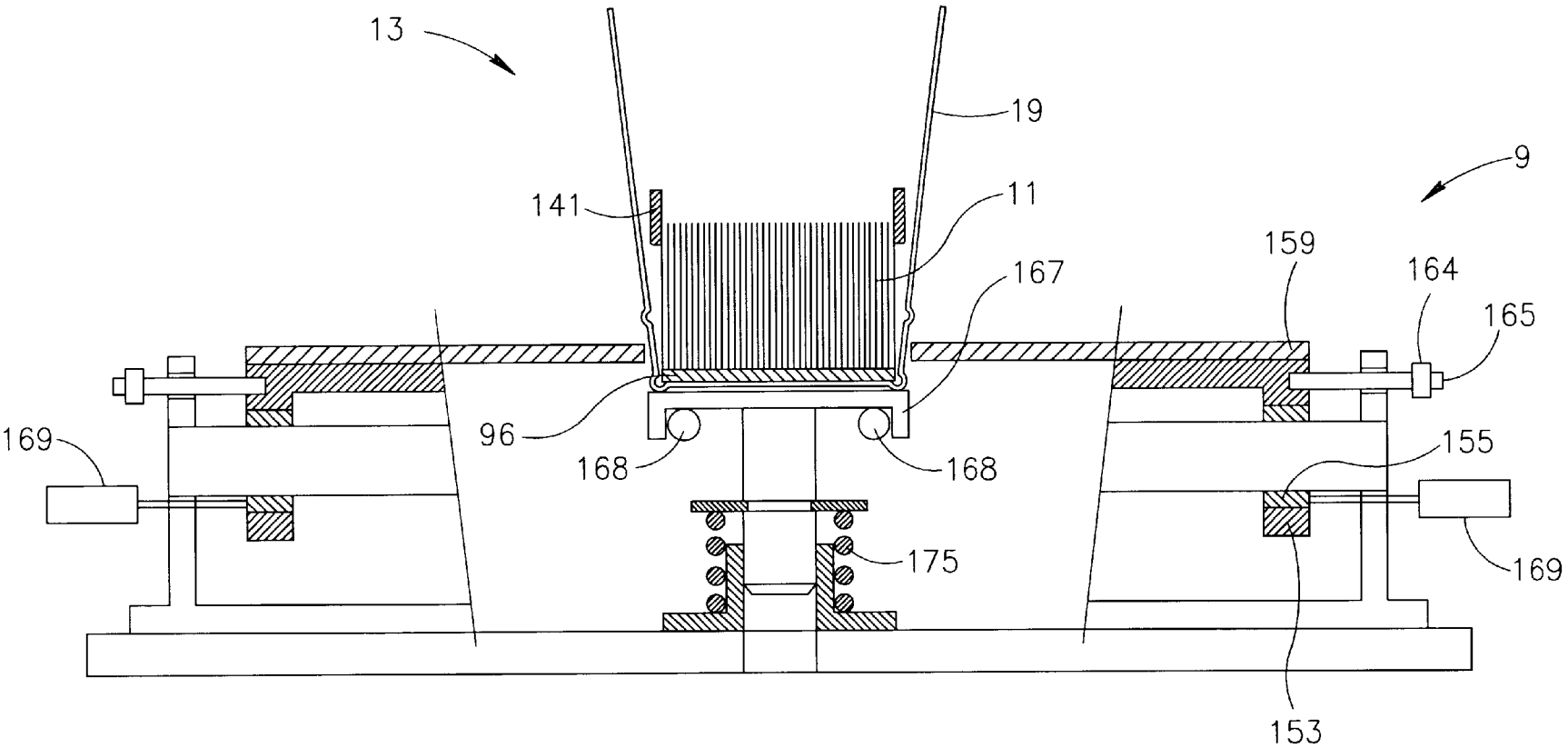
FIG. 11 is section view through the binding module 9 at operation 31 of FIG. 1 showing the pages being lowered into the glue strip.

As shown in FIG. 11, the clamped book block 11 is lowered onto the affixed glue strip 96. The collator 13 is pushed down to that the heating housing 167 is below the level of the movable plates 159, and the strip begins to melt. The collator with the book block 11 is then pushed down even further and the sheets come into intimate contact with the molten glue. When the housing is in this position, the CCU, activates the pneumatic cylinders 169 (FIG. 9), which force the movable plates 159 to press against the spine's sides, folding and closing the cover.

The CCU then deactivates the collator's clamp 141, releasing the book block 11. The collator 13 is raised by motor 124 (FIG. 3A) to its original level. The heaters 168 are turned off and the heater's housing 167 begins to cool. After a short period, the glue 96 solidifies, the pneumatic cylinders 169 retract, and the movable plates 150 release the book's spine. Finally, the CCU causes the finished book to be ejected and resets the machine for the next binding operation. The ejection mechanism is not shown and is not part of this invention.

Figure 12A:
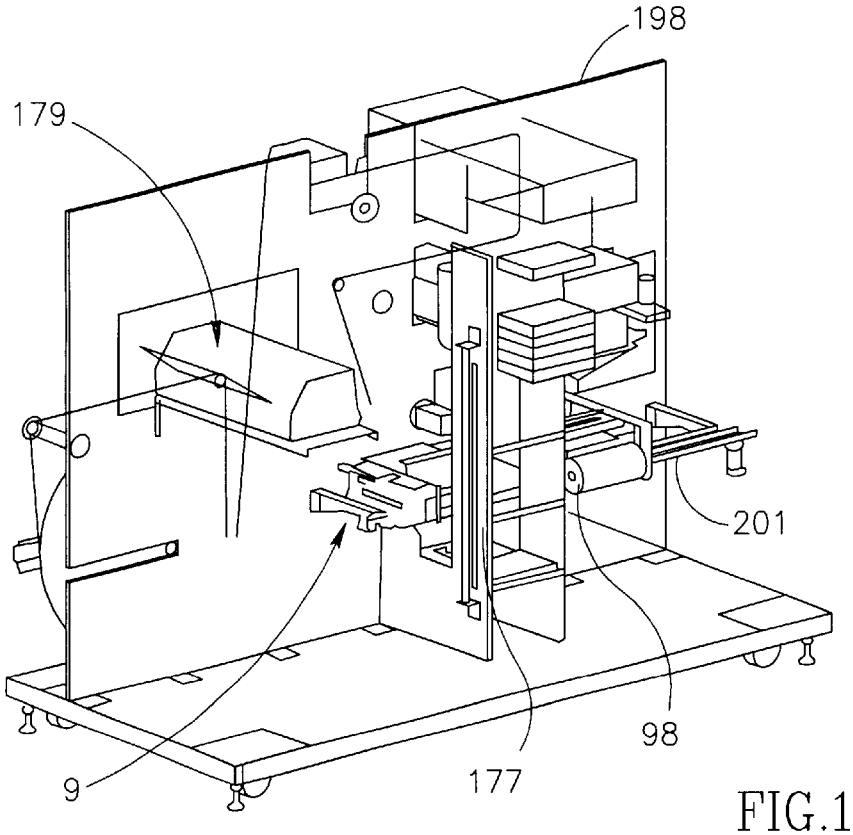
FIGS. 12A and 12B are front and back views of a finishing apparatus in use with an on-demand printer.
Figure 12B:
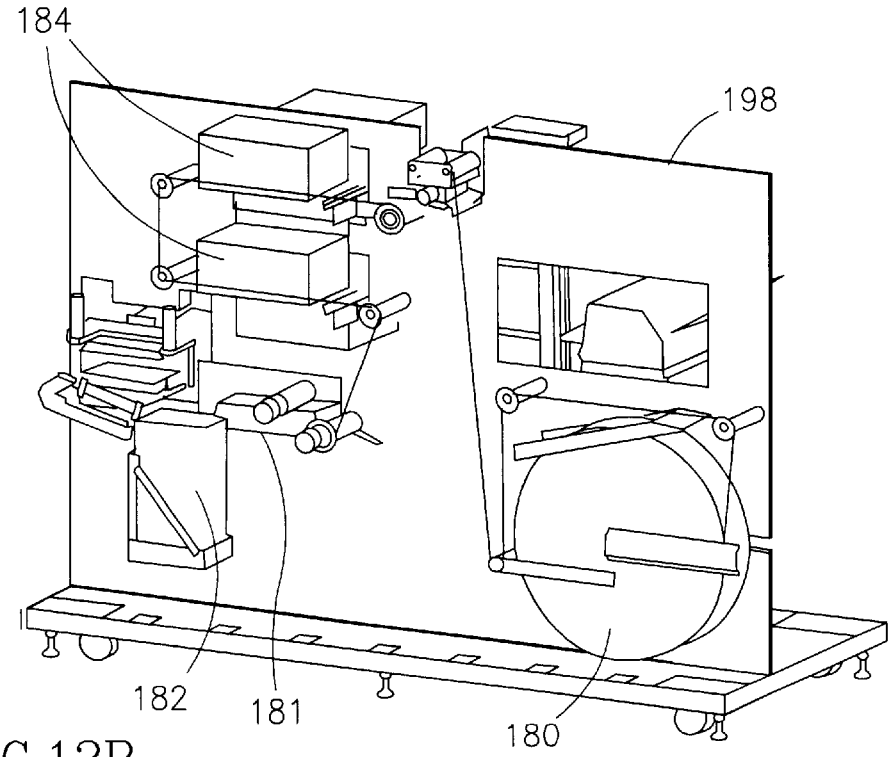

FIGS. 12A and 12B are front and back views of the finishing apparatus in use with an exemplary on-demand digital printer. The printing (FIG. 12B) and finishing (FIG. 12A) functions in the machine are physically separated by partition 198. A print web 180 moves through a digital printer 184, here an ink jet printer. A sheeter 181 cuts the printed web, and the initial sheets, which are unused, drop into the trash bin 182. A glue tape roll 8 is seen as is binding module 9 and a separate cover printer 179. The latter may be an on-demand cover printer. A travel movement 210 on which the movable plates 159 move, similar to the one shown in FIG. 7B, is shown. FIG. 12B does not show any scorers. A completed book delivery system 177 is also shown. A finishing apparatus as in FIG. 12A is easily incorporated into a book vending machine.

The embodiment of the invention discussed above, describes a finishing apparatus which can bind books only a single length (L in FIG. 4B). The addition of motors and mechanisms however can turn a fixed book size machine into a variable one. For example, in FIG. 2, the addition of motors to pins 135 will enable the latter to move in grooves 136A permitting the apparatus to use different sheet sizes.

In embodiments where the sheet length varies, a second knife must be added to cut the length of the glue strip and agree it to the height of the book (L in FIG. 4B). The second knife would have its cutting edge oriented perpendicular to the cutting edge of the roller cutter 99 of FIG. 8A or the guillotine cutter 99 of FIG. 8B.

While the preferred embodiment described above employs hot-melt glues, another embodiment can use pressure sensitive glues. This would obviate the need for heating elements 168 to melt the glue but would still requiring a cutting mechanism. Alternatively, heating elements still could be present but activated only when a hot-melt glue is used.

Figure 10A:
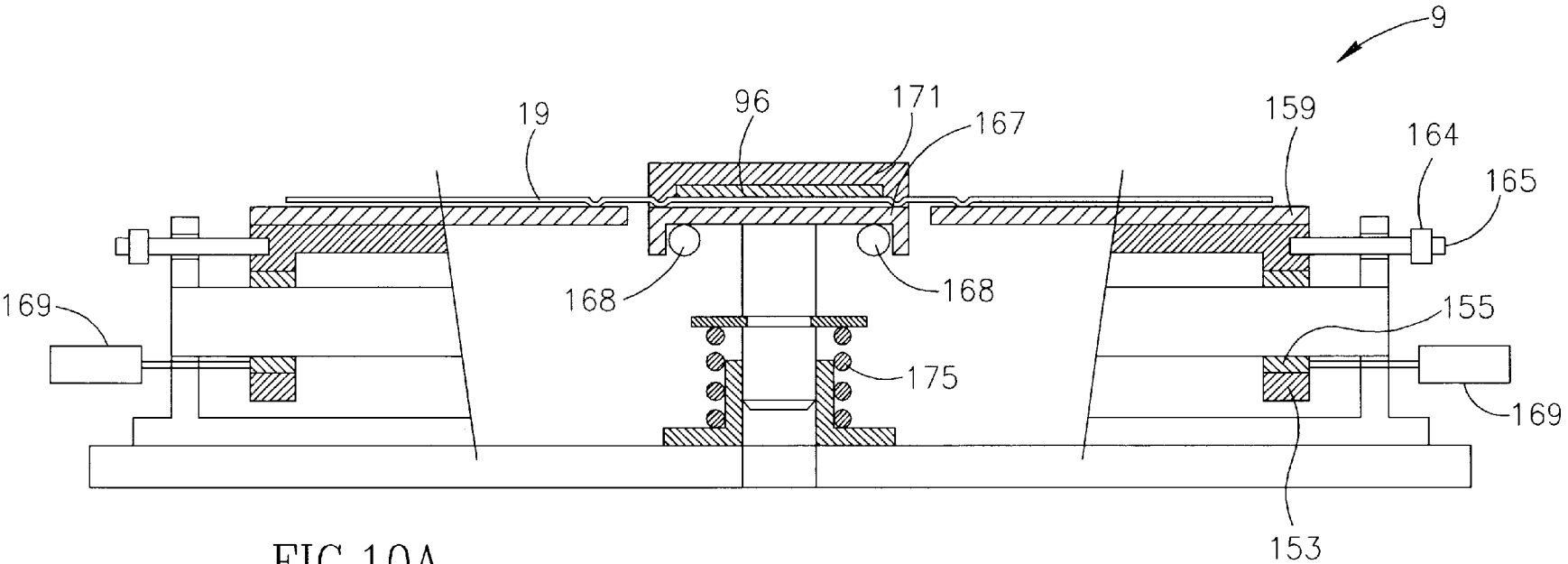
FIG. 10A is a section view through the binder shown in FIG. 9 with a cover and a glue strip affixed to it.
Figure 10B:
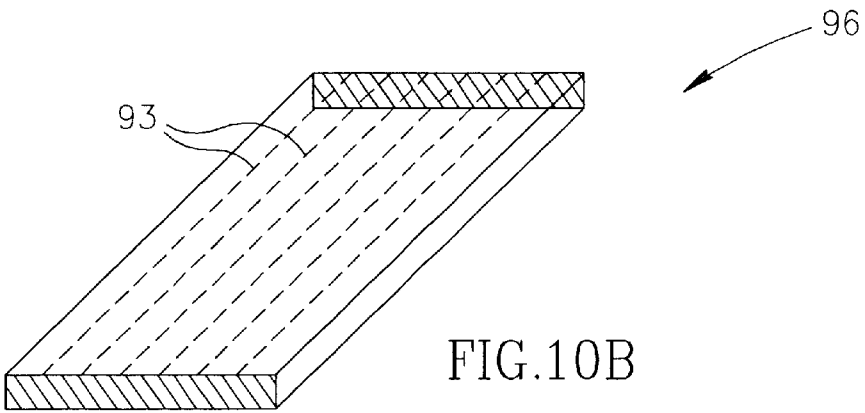
FIG. 10B is a schematic illustration of a glue strip having a wire.

Heating of a hot-melt glue has been described in the preferred embodiment as being effected by a heating element or elements. In other embodiments of the apparatus, other types of heating sources, such as RF, IR and hot air heating sources could replace the heating element(s). In yet another embodiment, the glue strip can contain a conductive wire 93 in it (See FIG. 10B). When attached to two contacts 171 (only one is shown in FIG. 10A) on the apparatus, a current can flow through the glue strip, melting it.

In other embodiments, a heater (not shown) can be added to the GC 29 or binder 9 modules to pre-heat the movable plates 159 preventing premature hardening of the melted glue.

The embodiment discussed above envisions a finishing machine connected to a cover printer. It is evident that an alternative embodiment can use pre-printed covers which can be fed into the travel movement 201 at positioning station 199.

Figure 3B:
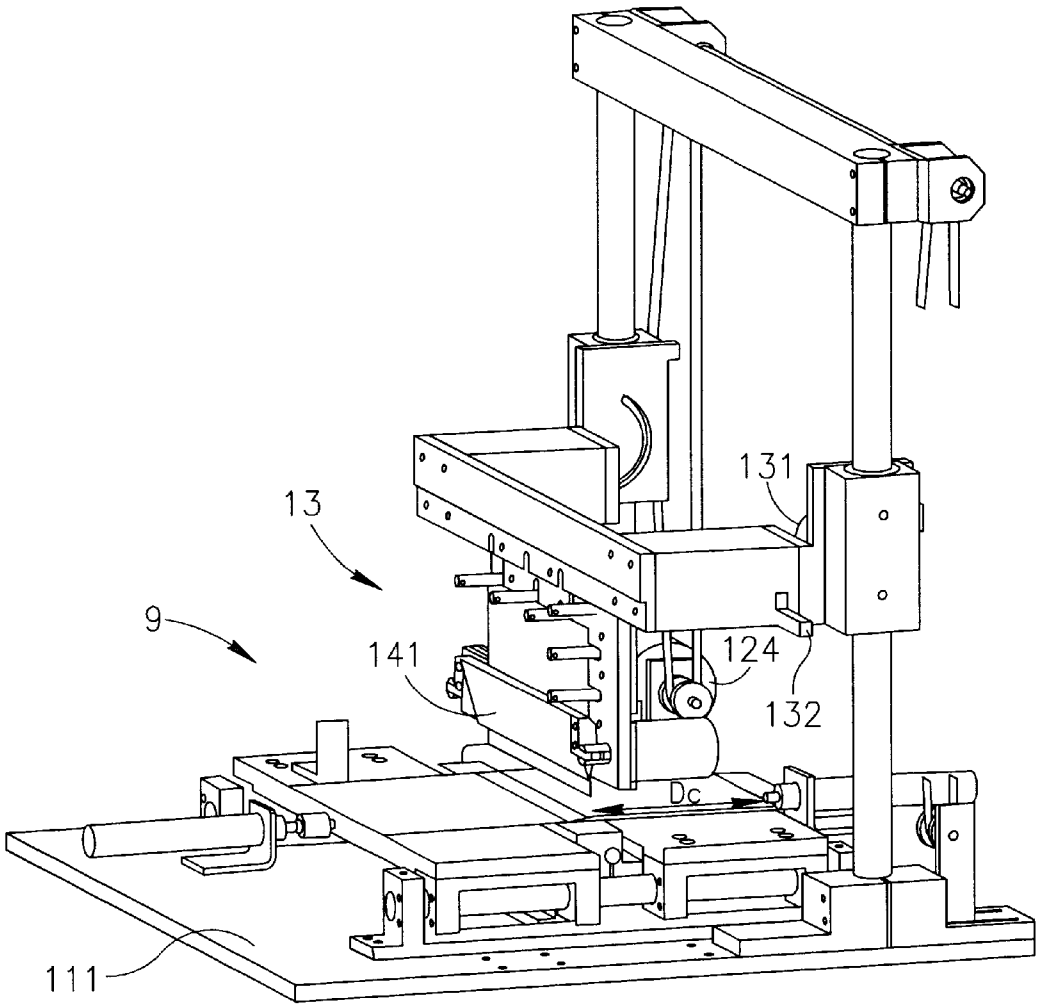
FIG. 3B is an isometric view of the collator and the binder with collator full, clamped and rotated downwards.

In the preferred embodiment described through and seen in FIGS. 3B and 11, there is rotation and lowering of the collated book block. However, other embodiments are also possible and the collation, rotation and lowering mechanisms can be generalized. The apparatus can have any configuration but usually it will have a configuration that will permit the book block to be brought into substantially perpendicular contact with the cover.

If the book cover is held vertically during processing, the book block would be rotated and brought into contact with the glue strip on the book cover by a horizontal displacement. Similarly, if the book cover is inclined (with its face either above or below the horizontal plane) the book block can be brought into contact with the cover from above or below the horizontal plane as the case may be. However, usually, the approach and contact of the book block with the cover (and glue strip) will be substantially perpendicular.

While the preferred embodiments of the present invention have been described so as to enable one of skill in the art to practice the present invention, the preceding description is intended to be exemplary only. It should not be used to limit the scope of the invention, which should be determined by reference to the following claims.

What is claimed is:

1. An automatic book-finishing apparatus for finishing a book, the book having a spine of any width, the apparatus comprising:

a pre-binding cover trimmer which trims a book cover, the book cover having a rectangular center area to be coincident with said spine, said center area having a long edge and a short edge, wherein the length of said short edge is automatically adjustable according to the total number of pages in a specific book;

a glue cutter which cuts a glue tape into a glue strip of variable width and aligns said glue strip with said long edge;

a collator which collates said aligns printed sheets into a book block of variable width and further aligns said book block with said long edge; and a binder which binds said book along said spine.

2. Apparatus according to claim 1, wherein said glue strip having a width generally equivalent to the length of said short edge.

3. Apparatus according to claim 1 wherein said glue cutter position said glue strip on said book cover and aligns said glue strip with said long edge.

4. Apparatus according to claim 1 wherein said collator includes means for collating said printed sheets into a book block, and means for aligning the edges of said printed sheets to an end surface of said collator and further aligning said book block with said long edge of said center area.

5. Apparatus according to claim 1 and wherein said collator comprises:

collating means which collates and aligns printed sheets into a book block;

clamping means which clamps said book block when collating is completed;

rotating means which rotates said book block to a position substantially perpendicular to said book cover after said book block has been clamped; and aligning means which aligns said book block along said long edge.

6. Apparatus according to claim 5 wherein said collating means comprises:

a receiver unit for receiving said printed sheets, said unit comprising a base and a plurality of restraining elements mounted on said base, said restraining elements forming a rectange generally of the same size as said printed sheets;

at least one active element which tamps and aligns said printed sheets when they are within said receiver unit; and a synchronizer which activates the at least one active element when a paper sheet is provided to said receiver unit.

7. Apparatus according to claim 6 wherein said at least one active element is at least two active elements and at least two of the active elements are disposed at about 90° to each other.

8. Apparatus according to claim 6 wherein said at least one active element is at least two active elements, said at least two active elements comprising a plurality of pneumatic cylinders and said restraining elements are a plurality of pins.

9. Apparatus according to claim 1 wherein the cover trimmer further comprises a scorer which scores said book cover with a plurality of scores, one of said plurality of scores being aligned co-linearly with said long edge.

10. Apparatus according to claim 9 wherein said plurality of scores is four scores, an inner pair serving as the edges of said spine and an outer pair serving as hinge-like grooves with which to open the book.

11. Apparatus according to claim 9 wherein said plurality of scores is a single pair of scores, said scores serving as the edges of said spine.

12. Apparatus according to claim 1 wherein said apparatus is integratable with an on-demand cover printer.

13. Apparatus according to claim 12 wherein said apparatus further comprises a central control unit which controls said on-demand cover printer and wherein said cover printer is in communication with the cover trimmer.

14. Apparatus according to claim 1 wherein said apparatus is integratable with an on-demand printing machine.

15. Apparatus according to claim 14 wherein said on-demand printing machine is a digital printer.

16. Apparatus according to claim 14 wherein said apparatus further comprises a central control unit which controls said on-demand printing machine.

17. Apparatus according to claim 1 which is connectable with a book vending machine.

18. Apparatus according to claim 1 wherein said apparatus further comprises a central control unit which controls at least one of the following: said collator, said cover trimmer, said glue cutter, and said binder.

19. The apparatus according to claim 1 and further comprising a sensor for determining book thickness, said sensor being in communication via a central control unit with at least one of the following: the glue cutter, the cover trimmer, and a book cover printer.

20. Apparatus according to claim 1 wherein said glue tape is a hot-melt glue tape.

21. Apparatus according to claim 20 wherein said binder further comprises a heating element for melting said hot-melt glue tape, said heating element being selected from one of the following: an electrical heating element, an RF heating element, an IR heating element and a hot air heating element.

22. Apparatus according to claim 20, wherein said binder further comprises electrical contacts, and said glue strip further comprises a wire such that when an electric current passes through said wire when said wire touches said contacts, the current flowing through said wire melts said glue strip.

23. Apparatus according to claim 1 wherein said glue tape is a pressure sensitive glue tape.

24. An automatic book-finishing apparatus for finishing a book and for use with an on-demand printing machine, the book having a spine of any width, the apparatus comprising:

pre-binding cover trimmer which trims a book cover, the book cover having a rectangular center area to be coincident with said spine, said center area having a long and a short edge, wherein the length of said short edge is automatically adjustable according to the total number of pages in a specific book;

a glue cutter which cuts a glue tape into a glue strip of variable width, said glue strip having a width generally equivalent to the length of said short edge of said center area, wherein said cutter also positions said glue strip on said book cover and aligns said glue strip with said long edge;

a collator which collates and aligns printed sheets into a book block of variable width and further aligns said book block with said long edge;

a binder which binds said book along said spine;

a central control unit in communication with and controlling at least one of the following: said collator, said cover trimmer, said glue cutter, and said binder, wherein said finishing apparatus is in communication with said printing machine.

25. Apparatus according to claim 24 wherein said collator includes means for collating said printed sheets into a book block, and means for aligning the edges of said printed sheets to an end surface of said collator and further aligning said book block with said edge of said center area.

26. Apparatus according to claim 24 and wherein said collator comprises:

collating means which collates and aligns printed sheets into a book block;

clamping means which clamps said book block when collating is completed;

rotating means which rotates said book block to a position substantially perpendicular to said book cover after said book block has been clamped; and aligning means which aligns said book block along said long edge.

27. Apparatus according to claim 26 wherein said collating means comprises:

a receiver unit for receiving said printed sheets, said unit comprising a base and a plurality of restraining elements mounted on said base, said restraining elements forming a rectangle generally of the same size as said printed sheets;

at least one active element which tamps and aligns said printed sheets when they are within said receiver unit; and a synchronizer which activates the at least one active element when a paper sheet is provided to said receiver unit.

28. Apparatus according to claim 27 wherein said at least one active element is at least two active elements and at least two of the active elements are disposed at about 90° to each other.

29. Apparatus according to claim 27 wherein said at least one active element is at least two active elements, said at least two active elements comprising a plurality of pneumatic cylinders and said restraining elements are a plurality of pins.

30. Apparatus according to claim 24 wherein the cover trimmer further comprises a scorer which scores said book cover with a plurality of scores, one of said plurality of scores being aligned co-linearly with said long edge.

31. Apparatus according to claim 30 wherein said plurality of scores is four scores, an inner pair serving as the edges of said spine and an outer pair serving as hinge-like grooves with which to open the book.

32. Apparatus according to claim 30 wherein said plurality of scores is a single pair of scores, said scores serving as the edges of said spine.

33. Apparatus according to claim 24 wherein said apparatus is integratable with an on-demand cover printer.

34. Apparatus according to claim 33 wherein said apparatus further comprises a central control unit which controls said on-demand cover printer and wherein said cover printer is in communication with the cover trimmer.

35. Apparatus according to claim 24 wherein said on-demand printing machine is a digital printer.

36. Apparatus according to claim 24 which is connectable with a book vending machine.

37. Apparatus according to claim 24 wherein said central control unit further controls said on-demand printing machine.

38. Apparatus according to claim 24 and further comprising a sensor for determining book thickness, said sensor being in communication with at least one of the following: the glue cutter, the cover trimmer, and a book cover printer.

39. According to claim 24 wherein said glue tape is a hot-melt glue tape.

40. Apparatus according to claim 39 wherein said binder further comprises a heating element for melting said hot-melt glue tape, said heating element being selected from one of the following: an electrical heating element, an RF heating element, an IR heating element and a hot air heating element.

41. Apparatus according to claim 39, wherein said binder further comprises electrical contacts, and said glue strip further comprises a wire such that when an electric current passes through said wire when said wire touches said contacts, the current flowing through said wire melts said glue strips.

42. Apparatus according to claim 24 wherein said glue tape is a pressure sensitive glue tape.

43. A method for use in an automatic book-finishing apparatus, the method comprising the steps of:

collating, aligning and clamping printed sheets into a book block having a spine;

rotating the aligned and clamped book block to a position substantially perpendicular to a book cover;

trimming said book cover before binding, said cover having a rectangular center area with a long and a short edge, said center area to be coincident with said spine;

cutting a glue strip from a glue tape, said glue strip having a width generally equivalent to the length of said short edge of said center area;

positioning said glue strip along said long edge of said center area;

aligning said book block with said glue strip along said long edge;

binding said book along said spine; and releasing said clamped book block.

44. A method according to claim 43 wherein said step of trimming also comprises a step of scoring said book cover, said scoring consisting of at least one score being co-linear with said long edge.

45. An apparatus comprising:

a collator to collate and to align printed sheets into a book block;

a trimmer to trim a book cover before binding such that its size is automatically adjustable according to a thickness of said book block;

a glue cutter to cut a glue tape into a glue strip having a width corresponding to said thickness; and a binder to bind said book block using said trimmed cover and said glue strip.

46. A method for use in an automatic book-finishing apparatus, the method comprising:

collating and aligning printed sheets into a book block;

trimming a book cover before binding such that its size is automatically adjustable according to a thickness of said book block;

cutting a glue strip, said glue strip having a width corresponding to said thickness; and binding said book block using said trimmed cover and said glue strip.

* * * * *